US007152700B2

(12) United States Patent
Church et al.

(10) Patent No.: US 7,152,700 B2
(45) **Date of Patent: *Dec. 26, 2006**

(54) DUAL WALL DRILL STRING ASSEMBLY

(75) Inventors: Kris L. Church, Montgomery, TX (US); William G. Riel, Wooster, OH (US)

(73) Assignees: American Augers, Inc., West Salem, OH (US); TorqueLock Corporation, Conroe, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/972,885

(22) Filed: Oct. 25, 2004

(65) Prior Publication Data

US 2005/0103527 A1 May 19, 2005

Related U.S. Application Data

(63) Continuation-in-part of application No. 10/712,324, filed on Nov. 13, 2003.

(51) Int. Cl.
*E21B 17/18* (2006.01)

(52) U.S. Cl. ..... 175/320; 138/114; 285/123.3

(58) Field of Classification Search ..... 175/320, 175/325.5, 325.6; 138/112, 114, 137; 285/123.3; 166/77.2

See application file for complete search history.

(56) References Cited

U.S. PATENT DOCUMENTS

| | | | | | |
|---|---|---|---|---|---|
| 2,494,803 | A | * | 1/1950 | Frost et al. | 285/123.1 |
| 3,065,807 | A | * | 11/1962 | Wells | 175/321 |
| 3,471,177 | A | * | 10/1969 | Garrett et al. | 285/123.3 |
| 3,664,441 | A | | 5/1972 | Carey | 175/215 |
| 3,786,878 | A | | 1/1974 | Chapman | 175/320 |
| 4,067,596 | A | | 1/1978 | Kellner et al. | 285/133 |
| 4,114,657 | A | | 9/1978 | Langenfeld | 138/109 |
| 4,280,535 | A | * | 7/1981 | Willis | 138/112 |
| RE32,267 | E | * | 10/1986 | Cherrington | 175/53 |
| 4,940,098 | A | | 7/1990 | Moss | 175/320 |
| 4,991,669 | A | | 2/1991 | Andersson | 175/135 |
| 5,178,223 | A | * | 1/1993 | Smet | 175/424 |
| 5,375,670 | A | | 12/1994 | Ekwall et al. | 175/215 |
| 5,497,839 | A | | 3/1996 | Moir | 175/65 |
| 5,566,771 | A | | 10/1996 | Wolfer et al. | 175/296 |
| 5,713,423 | A | * | 2/1998 | Martin et al. | 175/62 |
| 5,862,866 | A | | 1/1999 | Springer | 166/380 |
| 6,296,066 | B1 | * | 10/2001 | Terry et al. | 175/92 |
| 6,392,317 | B1 | | 5/2002 | Hall et al. | 307/90 |
| 6,892,829 | B1 | * | 5/2005 | Livingstone | 175/57 |

(Continued)

*Primary Examiner*—David Bagnell
*Assistant Examiner*—Daniel P Stephenson
(74) *Attorney, Agent, or Firm*—Charles D. Gunter, Jr.

(57) ABSTRACT

A coil tubing or jointed dual wall drill string assembly for subsurface drilling. The drill string assembly includes a metallic outer tube having an outer tube first end and an outer tube second end opposite the outer tube first end. The assembly also includes a flexible, substantially non-metallic inner tube that is substantially enclosed within and generally coaxially aligned with the outer tube. The flexible, substantially non-metallic inner tube has an inner tube first end, an inner tube second end opposite the inner tube first end, and an inner tube inner diameter. The inner tube and the outer tube define an annular channel therebetween. The drill string assembly also includes a means for conveying fluid through the annular channel toward the inner tube first end. The annular channel is adapted to convey drilling fluid under pressure toward the inner tube first end and the inner tube is adapted to convey cuttings toward the inner tube second end.

13 Claims, 11 Drawing Sheets

U.S. PATENT DOCUMENTS

2003/0141111 A1* 7/2003 Pia ..... 175/57

2004/0104052 A1* 6/2004 Livingstone ..... 175/61

* cited by examiner

DUAL WALL DRILL STRING ASSEMBLY

CROSS REFERENCE TO RELATED APPLICATIONS

The present application is a continuation-in-part of Ser. No. 10/712,324, filed Nov. 13, 2003, entitled "Dual Wall Drill String Assembly", by William G. Riel and Kris L. Church.

BACKGROUND OF THE INVENTION

1. Field of the Invention

The present invention relates generally to drill string assemblies. More particularly, the invention relates to a dual wall drill string assembly for use in subsurface drilling applications.

2. Background and Description of the Prior Art

Drill pipe is used in various ways and for different applications including mining for precious gems, precious metals or coal; installing public and private utilities; drilling for oil and various gases including coal methane; creating an avenue to link the surface to one or more reservoirs; and linking a location on the surface or the subsurface with another surface or subsurface location. Accordingly, drill pipe comes in specialized configurations particularly adapted for use in one or more different applications. For example, drill pipe may comprise a single wall construction made from exotic steels to withstand hostile fluid and gases. Alternatively, drill pipe may comprise a dual wall construction adapted for use in reverse circulation drilling applications. Traditional drill pipe is "jointed," i.e., it is made up of sections of pipe having opposing threaded ends. The pipe string typically is comprised of a series of pipe sections, which are screwed together by "tool joints" or upset connections. However, Flush Joint designs are becoming popular because of higher performance threads such as the "wedge threads". Depending upon the application and environmental issues, a particular type of drill pipe may be preferable to another based upon cost, proven scientific principles, physical limitations and the like.

For example, coil tubing drilling is another technique utilized commercially at the present time. Coil tubing is not "jointed" in the sense of traditional drill pipe. Rather, a continuous length of manufactured tubing having an O.D. on the order of 1–3½ inches is spooled onto, for example, a 40 foot diameter reel. An injector head utilizing gripper blocks and a contra-rotating chain drive system is typically used to feed the coil tubing into the well bore. Coil tubing offers a number of advantages over conventional jointed drill pipe in some situations. These include the ability to drill and trip under pressure, faster trips, continuous circulation while tripping pipe, slim hole and thru tubing capability, a small location footprint, portability and a safer work area on the rig site.

More exotic drilling, completion and production operations also continue to evolve in the oil and gas industries. For example, drilling operations are now being conducted in regions of the arctic permafrost, and other regions, for methane hydrate. One source of methane hydrate is the world's sea beds where the combined actions of heat, pressure and time on buried organic material produce methane. Over the eons, organic rich source beds are converted into large quantities of oil and natural gas. Along with the oil, the natural gas (largely methane) migrates upwardly from sea beds due to its natural buoyancy. If sufficient quantities reach a zone of hydrate stability, the methane gas will combine with formation water to form methane hydrate. In some circumstances, these deposits can provide sufficient in-place resources as to be suitable for economic drilling and production.

Regardless of the application, conventional single-walled drill pipe and coil tubing have traditionally utilized the same basic drilling technique: fluids such as drilling muds are pumped down the inside of the pipe and cuttings produced by the drilling process are carried with the drilling mud to the earth's surface along the outside of the drill pipe. More particularly, the cuttings are carried out of the hole either between the borehole and the drill pipe or between a cased hole and the drill pipe. Some exotic types of drilling such as under balanced drilling deal with the pressure differential between the bottom hole pressures and the surface pressures. This method of drilling is controllable, but it is dangerous.

In addition, single-walled drill pipe exposes the borehole to the drilling mud or fluids until the borehole is cased or cemented. Further, when the returned drilling mud or fluids and cuttings pass along the drilled hole, the hole can become packed between the drill pipe and the hole from the cuttings, thereby limiting the movement of the drill pipe. One technique employed to overcome the problem of pipe sticking is to increase the mud flow volume and to circulate the borehole before further drilling is performed. This technique, however, impacts the earth's formation, for example, by forming or opening cracks in the formations. Typically, much, if not all of the additional mud flows into the cracks and/or produces additional cracks. In addition, when the hole is close to the surface, the additional mud can seep or flow to the surface in a process known as "fracing out," which raises environmental concerns. Also it has been proven that low pressure gas wells are being abandoned because this process results in plugging and sealing off the avenue of producing natural gas. Reverse circulation air hammer drilling has produced low pressure gas wells, where previous standard drilled holes utilizing mud showed no evidence gas was present.

Reverse circulation drilling is a distinct drilling technique in which fluids are pumped to the drill bit and cuttings are transferred back to the earth's surface within the drill pipe assembly. This technique can be very advantageous because the drilling mud or fluid has limited exposure to the borehole and creates negligible damming effect. Also, it is environmentally-friendly in drilling applications that involve sensitive aquifers for drinking water and the like. The drill pipe typically used in reverse circulation drilling, however, is very stiff and difficult to steer and bend in a borehole. Thus, its use is limited to relatively straight hole applications, and it is not typically used in deviated hole drilling applications, which are commonly used in the construction, oil and gas, and mining industries.

In conventional drill pipes, wires are typically inserted and spliced inside each drill pipe to communicate with a gyroscope or compass transmitter in order to identify the location of the drill bit below the earth's surface. However, these wires are typically exposed and, therefore, are vulnerable to damage from short circuiting and breakage during the drilling operation.

It would be desirable, therefore, if an apparatus could be provided that would permit double-walled drill string pipe sections to be used for reverse-circulation, horizontal directional and deviated vertical drilling. It would also be desirable if a coil tubing apparatus could be provided which offered the advantages of such a double wall drill string. It would also be desirable if such an apparatus could be provided that would permit the double-walled drill string pipe sections to bend along the arcuate path of a subsurface borehole as freely as a single-walled drill pipe. It would be further desirable if such an apparatus could be provided that would convey larger-sized cuttings and increased volumes of cuttings from the drilling mechanism to the surface of the ground. It would be further desirable if such an apparatus could be provided that would permit drilling in soft, medium or hard rock formations as well as corrosive formations with reduced negative environmental impact and reduced borehole wall damage. It would be a further advantage if an apparatus was provided suitable for permafrost drilling operations, such as operations to drill and recover methane hydrate.

It would be further desirable if such an apparatus could be provided that would reduce or eliminate the risk of short circuiting the conductive wires on the drill string pipe sections. It would also be desirable if such an apparatus could be provided that would permit an operator at the ground surface to know immediately what rock or soil formation the drill is cutting as well as the condition of the drill bit. It would be still further desirable if such an apparatus could be provided that would produce a more efficient drilling mechanism by decreasing discharge back pressure experienced during drilling operations utilizing conventional drill pipe. It would be further desirable if such an apparatus could be provided that would achieve longer pilot borehole distances and have a longer lifespan in the borehole. It would also be desirable if such an apparatus could be provided to electronically sense the hole pressures and differential pressures between the ID and OD at close proximity to the drill bit, as well as at other appropriate locations along the drill string length. It would be further desirable if an apparatus could be provided to "smell" or detect hazardous gases, such as $H_2S$, in the down hole environment. It would be still further desirable if such an apparatus could be provided that would permit the apparatus to be more easily assembled and perform drilling more efficiently, more quickly, and less costly. It would still further be desirable if such an apparatus could be provided to have an electric motor turn the drill bit instead of turning the drill pipe to limit or raise the fatigue life of the drill string. It would also be desirable if such an apparatus could be provided to be able to adjust the angle of the adjustable bent sub electrically, which can enable a bit, after drilling the hole with casing being installed simultaneously, to pull through the casing, leaving the casing in place. It would be further desirable if such an apparatus could be provided to have an electric motor(s) between the bit and bent sub, in order to deviate on a planned path so as to optimize the drilling task.

3. Advantages of the Invention

Accordingly, it is an advantage of the invention claimed herein to provide an apparatus that includes double-walled drill string pipe sections adapted for use in all subsurface drilling applications, it is another advantage of the invention to provide an apparatus having an inner tube adapted to bend to the arcuate path of a borehole with little or no resistance. It is also an advantage of the invention to provide an apparatus capable of conveying larger-sized cuttings and increased volumes of cuttings from the drilling mechanism to the surface of the ground. It is also an advantage of the invention to provide an apparatus that is capable of drilling in soft, medium or hard formations, permafrost formations, as well as corrosive formations with reduced negative environmental impact and reduced borehole wall damage. It is a further advantage of the invention to provide an apparatus that reduces or eliminates the risk of short circuiting the conductive wires on the drill string pipe sections. It is a still further advantage of the invention to provide an apparatus that permits an operator at the ground surface to know what rock or soil formation the drill is cutting and the location of the drill bit. It is also an advantage of the invention to electronically sense the hole pressures and differential pressures between the ID and OD at close proximity to the drill bit, as well as at other appropriate locations along the drill string length. It is another advantage of the invention to provide an apparatus that can detect the presence of hazardous gas, such as $H_2S$. It is another advantage of the invention to provide an apparatus that produces a more efficient drilling mechanism by decreasing the incidence of "fracing out" of the subsurface formation. It is yet another advantage of the invention to provide an apparatus that achieves longer pilot borehole distances and has a longer lifespan in the borehole. It is a further advantage of the invention to provide an apparatus that is more easily assembled and performs all subsurface drilling more efficiently, more quickly, and less costly. It is a still further advantage to have an electric motor(s) turn the drill bit instead of turning the drill pipe to limit or raise the fatigue life of the drill string. It is a still further advantage to be able to adjust the angle of the adjustable bent sub electrically, which can enable a bit, after drilling the hole with casing being installed simultaneously, to pull through the casing, leaving the casing in place. It is a still further advantage to have an electric motor(s) between the bit and bent sub, so in order to deviate on a planned path so as to optimize the drilling task. Another aspect of the invention is the provision of a coil tubing apparatus which utilizes a "tube within a tube" design to achieve the aforesaid advantages of dual wall drill pipe. Additional advantages of the invention will become apparent from an examination of the drawings and the ensuing description.

4. Explanation of the Technical Terms

As used herein, the term "arcuate" refers to a curving, bending, turning, arching or other non-straight line, path or direction. As used herein, the term "arcuate path that is generally horizontal" refers to a borehole having an entry hole and a separate exit hole that are connected by a curved path. It is contemplated within the scope of the term "arcuate path that is generally horizontal" that the borehole may have a longer vertical component than its horizontal component.

As used herein, the term "conductive" means able to convey, transmit or otherwise communicate a signal and/or provide electrical current.

As used herein, the term "fluid" relates to a liquid, air, a gas, or a combination of liquid, gas, and/or air. The term "fluid" includes, without limitation, mixtures of solids and water, oils, other chemicals and the like.

As used herein, the term "signal" refers to a means for communication between a transmitter and a receiver. The term "signal" includes, without limitation, analog signals, digital signals, multiplexing signals, light signals and the like.

As used herein, the term "steerable" means the ability to follow the deviated path of a planned drilled hole.

As used herein, the term "substantially vertical borehole" refers to a borehole that is drilled substantially perpendicular to the earth's surface. The term "substantially vertical borehole" includes, without limitation, boreholes that are arcuate, curved and the like. It is also contemplated that the term "substantially vertical borehole" refers to a borehole that is a combination of vertical and horizontal drilling in relation to the earth's surface.

As used herein, the term "subsurface drilling" refers to any type of drilling, including vertical, horizontal and everything in between, employed by any industry that uses drill pipe to drill holes into the earth's formation, including, without limitation, soil, rock, ice, permafrost, wetlands, sand and the like.

The term "coil tubing" will be taken to mean any continuously-milled tubular product manufactured in lengths which require spooling onto a take-up reel during the primary milling or manufacturing process. Conventional coil tubing is constructed of carbon steel using the high-frequency induction welding process. Advanced metallic coil tubing strings are constructed using corrosion resistant alloys or titanium, with the seam weld formed using the TIG process.

The term "coil tubing unit" will be understood to mean an assembly of the major equipment components needed to perform a continuous-length tubing service or drilling operation. These basic equipment components generally include as a minimum an injector, service reel, control console, power supply, and well control stack assembly.

SUMMARY OF THE INVENTION

The invention claimed herein comprises a coil tubing or jointed dual wall drill string assembly and components for subsurface drilling. The drill string assembly in each case includes a metallic outer tube having an outer tube first end and an outer tube second end opposite the outer tube first end. The assembly also includes a flexible, substantially non-metallic inner tube that is substantially enclosed within and generally coaxially aligned with the outer tube. The flexible, substantially non-metallic inner tube has an inner tube first end, an inner tube second end opposite the inner tube first end, and an inner tube inner diameter. The inner tube and the outer tube define an annular channel there between. The drill string assembly also includes a means for conveying fluid through the annular channel toward the inner tube first end. The annular channel is adapted to convey drilling fluid under pressure toward the inner tube first end, and the inner tube is adapted to convey cuttings toward the inner tube second end. The drill string assembly also includes a means to detect increases in formation pressure and pressures along the length of the drill string as well as a means to detect the presence of hazardous gas in the formation. Components of the drill string can have electric or mud motor(s) to drill the hole. Also, another component may have an adjustable bent sub controlled by electricity.

In a preferred embodiment of the drill string assembly of the invention claimed herein, a conductive element is substantially enclosed within the flexible, substantially non-metallic (and if appropriate a substantially non-conductive material) inner tube and adapted to convey a signal to allow the operator to control the direction of the drilling mechanism. In another preferred embodiment, flexible sleeve(s) with openings are provided in the annular channel in order to maintain the outer tube and the inner tube in substantially concentric relationship to each other and permit fluid under pressure to be conveyed through the annular channel.

According to the method of the invention claimed herein, the dual wall drill string assembly is adapted to produce a subsurface borehole. In a preferred embodiment, the assembly is adapted to produce a substantially vertical subsurface borehole, a substantially horizontal subsurface borehole, or a borehole anywhere between vertical and horizontal, having an arcuate path. In another preferred embodiment, the assembly is adapted to pull a product into the arcuate path of a subsurface borehole.

A preferred embodiment of the invention utilizes a coil tubing drill string assembly for subsurface drilling. The assembly again has inner and outer tubes with an annular channel therebetween, as previously described. The outer tube is formed as a continuously-milled tubular product manufactured in lengths which require spooling onto a take-up reel during the primary milling or manufacturing process. When appropriate, a centralizer(s) is located in the annular channel formed between the inner and outer tubes adjacent each of a surface end and a bit end of the coil tubing, respectively, to assist in maintaining the annular channel between the outer tube and inner tube.

The surface end of the coil tubing is also supplied with a fluid supply and communication and power transmission adapter which includes an inlet for fluid supply flow inwardly and which also includes a conduit opening which accepts communication and power transmission connectors leading to a surface control console. The bit end of the coil tubing includes a tubing end adapter which has communication and power transmission connector(s). Preferably, the inner and outer tubes are separated by the centralizer(s) which are located adjacent the bit end and surface end of the coil tubing, respectively. The bit end of the coil tubing apparatus can be connected to a downhole adjustable or non adjustable bent sub, and/or electric or hydraulic and/or air motor(s).

The annular channel is adapted to convey drilling fluid under pressure toward the inner tube first end, and the inner tube is adapted to convey cuttings toward the inner tube second end. The coiled tubing is fed from a spool at the surface to an injector head which is used to feed the coiled tubing into a well bore to thereby drill a subsurface borehole. Pressure sensor(s) are located within the wall of the inner tube that sense pressure differentials between the outer and inner tube and also senses pressure inside the inner tube. Additionally, sensors are located within the wall of the inner tube that detect the presence of hazardous gas.

Additional objects, features and advantages will be apparent in the written description which follows.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
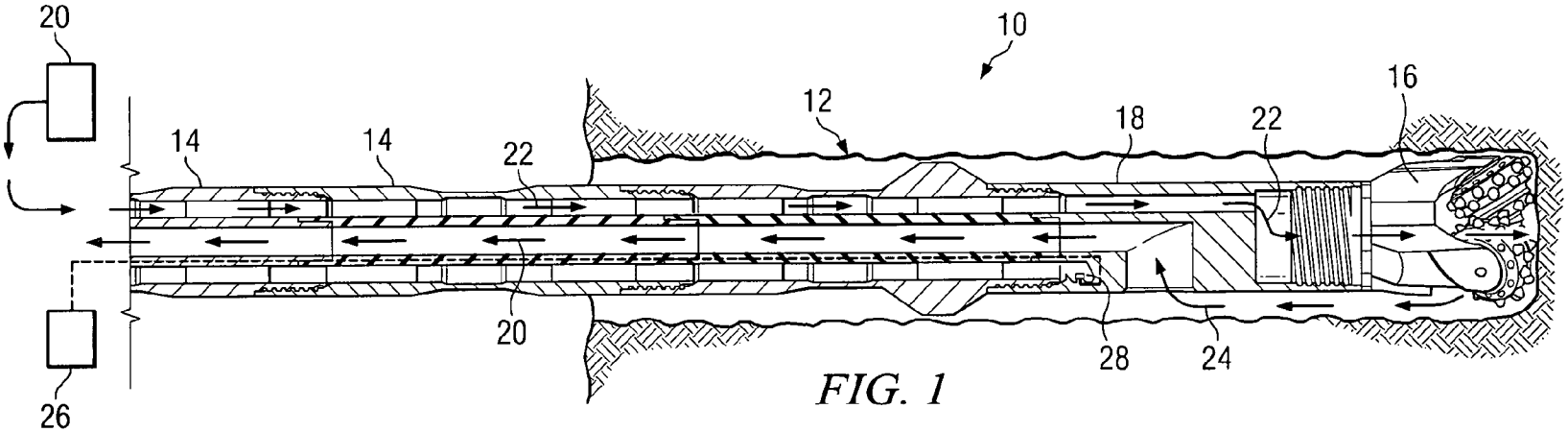
FIG. 1 is a sectional side view of a preferred embodiment of the bit end of the dual wall drill string assembly partially in a subsurface borehole in accordance with the present invention.

Referring now to the drawings, the various embodiments of the apparatus of the invention claimed herein are illustrated by FIGS. 1 through 18. FIG. 1 illustrates a preferred embodiment of the dual wall, jointed drill string assembly partially in a subsurface borehole. The preferred dual wall drill string assembly is designated generally by reference numeral 10 and the subsurface borehole is designated by reference numeral 12. As shown in FIG. 1, the preferred drill string assembly may comprise a plurality of dual wall pipe sections 14. It is contemplated, however, that the drill string assembly of the invention claimed herein may comprise a single dual wall pipe. The preferred drill string assembly may further comprise a drilling mechanism, an interchange sub, a means for conveying fluid under pressure, a signal source such as a transmitter or a source of electricity, a receiver, and a navigation transmitter as described in more detail below. It is further contemplated that the assembly may be used in connection with any suitable steering mechanism such as a bent sub or a deflectable drill bit as will be appreciated by one having ordinary skill in the art. The dual wall drill string assembly of the present invention is adapted for use in all subsurface drilling applications.

Referring still to FIG. 1, in the preferred drill string assembly, a plurality of dual wall pipe sections 14 are connected together to produce a dual wall drill string. As shown in FIG. 1 the preferred dual wall drill string comprising dual wall pipe sections 14 is connected to drilling mechanism 16 by interchange sub 18. Drilling mechanism 16 is adapted to produce cuttings as it drills subsurface borehole 12. Drilling mechanism 16 may be any suitable drilling mechanism adapted to drill a subsurface borehole such as a rotary cutter or a down-the-hole hammer.

Interchange sub 18 is adapted to direct cuttings from the drilling mechanism to the dual wall drill string assembly. More particularly, as discussed below, interchange sub 18 directs cuttings and fluid under pressure from the subsurface borehole into the inner tube of the dual wall drill string.

Interchange sub 18 maybe any suitable device adapted to direct cuttings from the drilling mechanism to the dual wall drill string. Also, the interchange sub drilling mechanism or use of a separate interchange sub may have communication capabilities such as a location transmitter. It is also contemplated that the drill string assembly of the invention may not require an interchange sub because a channel through which cuttings may be transferred from the drilling mechanism to the drill string may be incorporated into the drilling mechanism.

Still referring to FIG. 1, the preferred drill string assembly also includes a means for conveying fluid through the dual wall drill string towards the drilling mechanism such as pump 20. More particularly, as discussed below, pump 20 is adapted to convey fluid under pressure through an annular channel defined by the outer tube and the inner tube of the dual wall drill string towards drilling mechanism 16. The flow of fluid from pump 20 through the annular channel of the dual wall drill string and, thereafter, through interchange sub 18 towards drilling mechanism 16 is designated by arrowed line 22. The flow of cuttings and fluid from drilling mechanism 16 into interchange sub 18 and, thereafter, into the inner tube of the dual wall drill string is designated by arrowed lines 24. it is contemplated within the scope of the invention that the means for conveying fluid through the annular channel of the dual wall drill string toward the drilling mechanism may be any suitable means for conveying fluid under pressure.

As also shown in FIG. 1, the preferred embodiment of the dual wall drill string assembly includes signal source of electricity 26 adapted to provide an electrical current to navigation transmitter 28, which is adapted to indicate the direction of drilling mechanism 16. Source of electricity 26 may be any suitable source for providing an electrical current. Navigation transmitter 28 may be any suitable device adapted to monitor the direction of the drilling mechanism.

Figure 2:
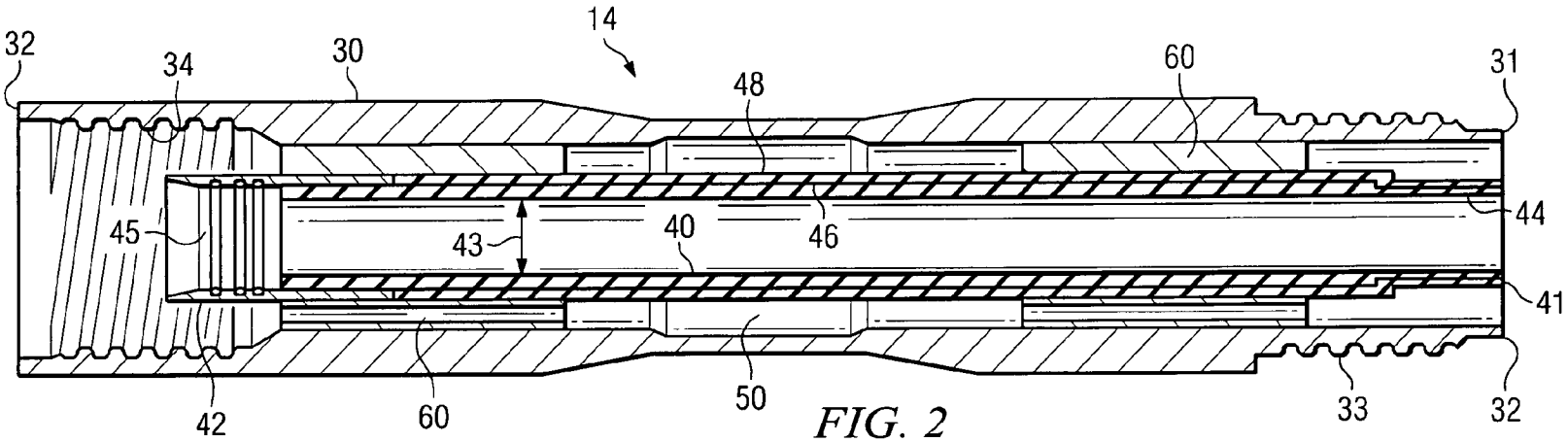
FIG. 2 is an enlarged sectional side view of the preferred dual wall drill string pipe section shown in FIG. 1.

Referring now to FIG. 2, an enlarged sectional side view of the preferred dual wall pipe section 14 shown in FIG. 1 is illustrated. Pipe section 14 includes metallic outer tube 30 having outer tube first end 31 and outer tube second end 32 opposite the outer tube first end. In a preferred embodiment, drilling mechanism 16 (See FIG. 1) is located adjacent to outer tube first end 31 of a dual wall pipe section such as pipe section 14. Outer tube first end 31 is adapted to be connected to the outer tube second end of another pipe section such that fluid may be conveyed under pressure in the outer tubes of the pipe sections. Outer tube second end 32 is adapted to be connected to the outer tube first end of another pipe section such that fluid may be conveyed under pressure in the outer tubes of the pipe sections. In a preferred embodiment, outer tube 30 of each dual wall pipe section 14 is rigid and includes a pair of threaded ends 33 and 34 adapted to be removably connected to a threaded end on another rigid outer tube section.

As shown in FIG. 2, the preferred dual wall pipe section 14 also includes flexible, substantially non-metallic inner tube 40 that is substantially enclosed within and generally coaxially aligned with outer tube 30. The non-metallic inner tube 40 can be formed of a variety of materials depending upon the particular drilling application at hand. For example, elastomers such as natural or synthetic rubber, polyurethane, flexible plastics, flexible carbon fiber, plastic composites, rubber composites, carbon composites, Nylons™, fiberglass, Rayon™, Teflon™, acrylics, polymers, etc., can be utilized in some situations. The preferred material for inner tube 40 will be dictated by the drilling conditions. For example, if hydrogen sulfide is present in the drilling environment, the inner tube material (and outer tube material) must be resistant to the gas.

If carbon dioxide is present, the inner and outer tube must not be harmed by or absorb this gas. Rubber is a convenient choice of material in many cases, since it can be formulated to specifically withstand the environment at hand.

Inner tube 40 includes inner tube first end 41, inner tube second end 42 opposite the inner tube first end, and an inner tube inner diameter designated by line 43. Inner tube first end 41 is adapted to be connected to the inner tube second end of another pipe section such that cuttings and fluid under pressure may be conveyed in the inner tubes of the pipe sections. Inner tube second end 42 is adapted to be connected to the inner tube first end of another pipe section such that cuttings and fluid under pressure may be conveyed in the inner tubes of the pipe sections. More particularly, an inner tube such as inner tube 40 is adapted to convey cuttings from drilling mechanism 16 toward inner tube second end 42. In a preferred embodiment, the drill string assembly is comprised of a plurality of pipe sections 14, each of which includes a flexible inner tube section 40, wherein each of the flexible inner tube sections has male connection end 44 and female connection end 45. Each male connection end 44 is adapted to be connected to a female connection end on another flexible inner tube section and each female connection end 45 is adapted to be connected to a male connection end on another flexible inner tube section. It is also preferred that each flexible inner tube section is in communication (as hereinafter described) with each adjacent flexible inner tube section.

Still referring to FIG. 2, the preferred inner tube 40 also includes conductive element 46 for conveying a signal such as an electrical signal from source of electricity 26 (See FIG. 1) to drilling mechanism 16 (See FIG. 1). The signal may be used to indicate the direction of the drilling mechanism. In a preferred embodiment, conductive element 46 is continuous from inner tube first end 41 to inner tube second end 42 so that a continuous conductive path is provided from one end of the drill string to the other and provides an electrical current from the source of electricity to a navigation device. It is also preferred that conductive element 46 is substantially enclosed within inner tube 40. Furthermore, conductive element 46 preferably comprises at least one metallic or fiber optic material. It is also preferred that conductive element 46 includes metallic wire, metallic mesh or thin wall pipe. It is contemplated within the scope of the invention, however, that conductive element 46 may be any suitable material for conveying a signal such as an electrical current.

The preferred inner tube also includes a means for reinforcing the inner tube such as mesh 48. Mesh 48 is adapted to provide structural support to the flexible, substantially non-metallic inner tube. More particularly, mesh 48 is adapted to enable inner tube 40 to withstand greater pressure differentials between the pressure in annular channel 50 and the pressure in the inner tube. In other words, mesh 48 provides the inner tube with resistance against collapsing when the pressure in the annular channel becomes significantly greater than the pressure in the inner tube, and resistance against bursting when the pressure in the inner tube becomes significantly greater than the pressure in the annular channel. In addition, mesh 48 is adapted to minimize the bending resistance of the inner tube. As a result, mesh 48 does not significantly impair the steerability of the drill string assembly. Mesh 48 may be made from wire mesh, fabric mesh, thin wall metallic tube or any other suitable material adapted to provide resistance against pressure differentials between the annular channel and the inner tube and minimize resistance against bending or steering the inner tube. Typical candidate materials include steel, steel alloys, stainless steel, stainless steel alloys, Incoloy™, copper, copper based alloys, brass, brass based alloys, fiberglass, Rayon™, Nylon™, plastics and non-conductive materials. An appropriately placed mesh maybe utilized as shielding from cross talk with respect to the signal carrying conductive elements of the apparatus. It is contemplated that mesh 48 may be located throughout the inner tube or in designated areas. It is further contemplated that mesh 48 may be substantially enclosed within the inner tube, applied to the exterior or interior surfaces of the inner tube, or a combination thereof.

Referring still to FIG. 2, outer tube 30 and inner tube 40 define annular channel 50 there between. The annular channel is adapted to convey fluid under pressure from the means for conveying fluid such as pump 20 (See FIG. 1) toward the inner tube first end. More particularly, annular channel 50 is adapted to convey drilling fluid under pressure from inner tube second end 42 toward inner tube first end 41.

As shown in FIG. 2, the preferred dual wall pipe section 14 also includes at least one centering member such as flexible sleeve 60 that is located in annular channel 50. In a preferred embodiment, at least one flexible sleeve 60 is adapted to maintain outer tube 30 and inner tube 40 in a substantially concentric relationship to each other. Also in a preferred embodiment, flexible sleeve 60 has at least one opening therein such as holes 262 (See FIG. 5A). In an alternative embodiment, flexible sleeve 360 includes apertures 362 (See FIG. 5B). It is also preferred that the cumulative area of the openings in the flexible sleeves is greater than the cross sectional area defined by inner tube inner diameter 43.

Figure 3:
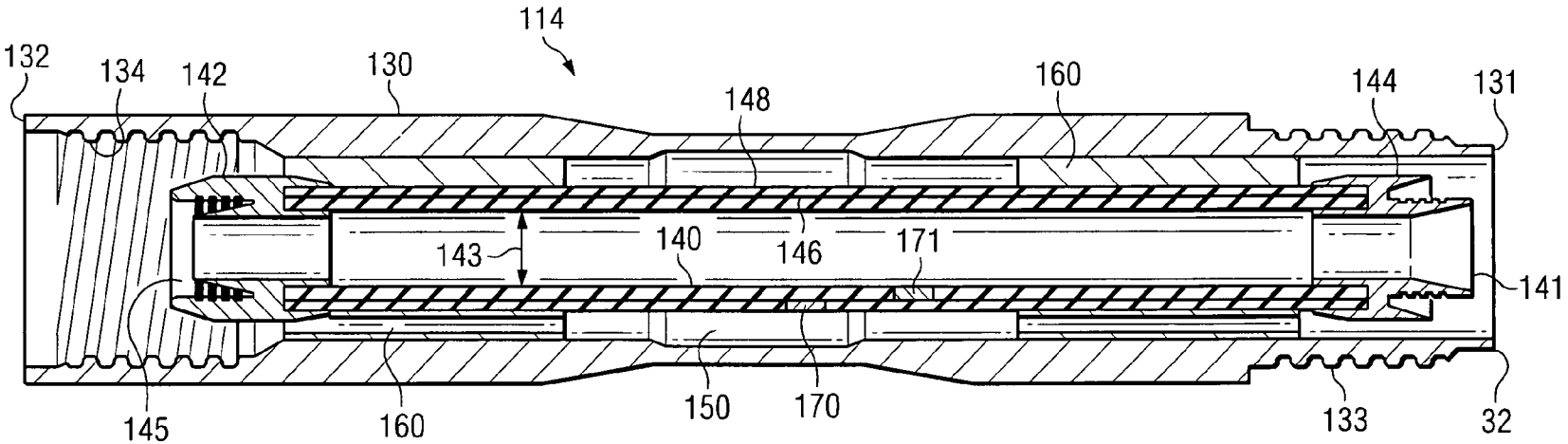
FIG. 3 is a sectional side view of an alternative embodiment of the dual wall drill string pipe section in accordance with the present invention.

Referring now to FIG. 3, an alternative embodiment of a dual wall pipe section is illustrated. More particularly, FIG. 3 illustrates an alternative embodiment of the male connection end and the female connection end of the flexible, substantially non-metallic inner tube of a dual wall pipe section. As shown in FIG. 3, dual wall pipe section 114 includes metallic outer tube 130 having outer tube first end 131 and outer tube second end 132 opposite the outer tube first end. The outer tube also includes a pair of threaded connections 133 and 134 adapted to be connected to the threaded connections of another pipe section 114. Pipe section 114 also includes flexible, substantially non-metallic inner tube 140. Inner tube 140 includes inner tube first end 141, inner tube second end 142 opposite the inner tube first end, and inner tube inner diameter designated by line 143. Inner tube 140 also includes male connection end 144 and female connection end 145 which are adapted to be connected to the female connection end and the male connection end, respectively, of an inner tube of another pipe section such that adjacent pipe sections are in communication with each other, fluid can be conveyed under pressure through annular channel 150, and cuttings and fluid under pressure can be conveyed in the inner tubes of the pipe sections.

Inner tube 140 also includes conductive element 146, stiffener 148 and flexible sleeves 160. While stiffener 148 is shown on the outside surface of preferred inner tube 140, it is contemplated within the scope of the invention that one or more stiffeners may be located on the inside surface of the inner tube or substantially or entirely enclosed within the inner tube. Inner tube 140 has outer pressure sensor 170 which detects abnormal pressures or measures pressure to compare the inner pressure sensor readings. Inner tube 140 has inner pressure sensor 171 which detects abnormal pressures or measures pressure to compare to the outer pressure sensor readings.

Figure 4A:
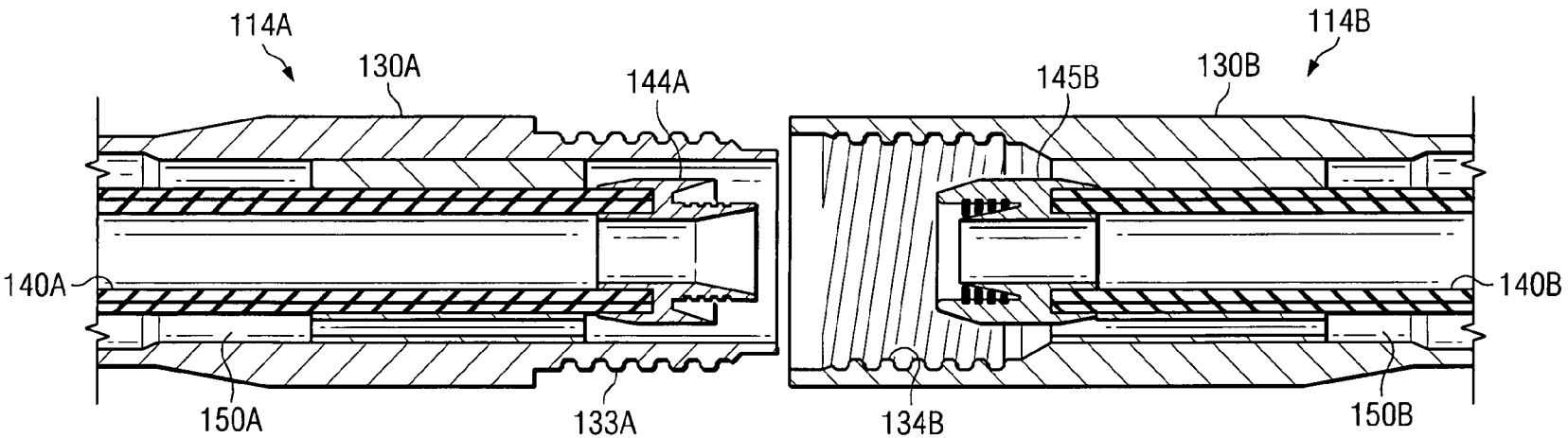
FIG. 4A is a sectional side view of a pair of the dual wall drill string pipe sections shown in FIG. 3.
Figure 4B:
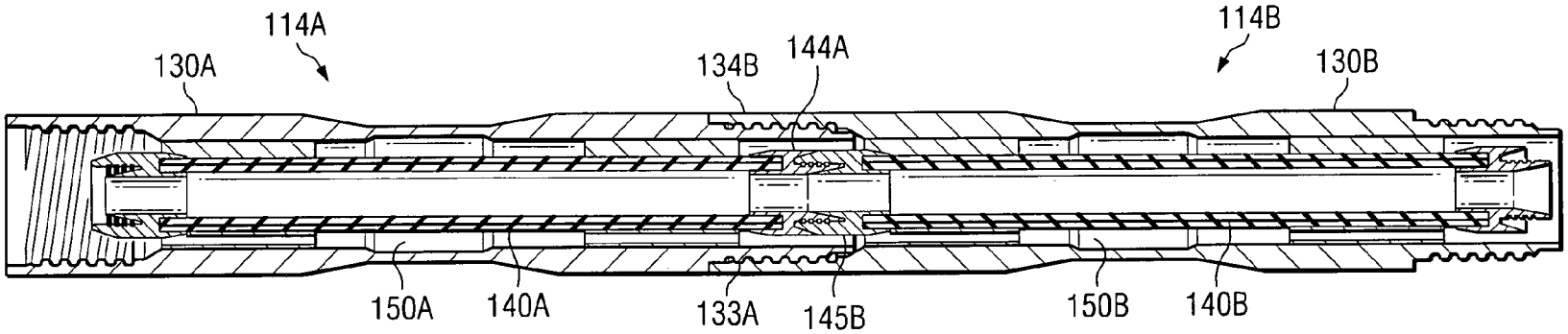
FIG. 4B is a sectional side view of the pair of dual wall drill string pipe sections shown in FIG. 4A connected to each other.

Referring now to FIGS. 4A and 4B, a pair of dual wall pipe sections are illustrated in nearly-connected and connected disposition, respectively. More particularly, FIG. 4A shows a pair of pipe sections 114A and 114B in a nearly-connected relationship to each other. As shown in FIG. 4A, pipe section 114A includes metallic outer tube 130A having threaded end 133A adapted to be connected to threaded end 134B of outer tube 130B of pipe section 114B. Pipe section 114A also includes flexible, substantially non-metallic inner tube 140A. Inner tube 140A includes male connection end 144A which is adapted to be connected to female connection end 145B of inner tube 140B of pipe section 114B. Male connection end 144A and female connection end 145B are adapted to be connected to each other such that inner tubes 140A and 140B are in communication with each other and cuttings and fluid under pressure can be conveyed through annular channels 150A and 150B of pipe sections 114A and 114B, respectively.

Referring now to FIG. 4B, the preferred pipe sections shown in FIG. 4A are illustrated in connected relationship to each other. More particularly, threaded ends 133A and 134B of outer tubes 130A and 130B, respectively, are shown in full threaded engagement with each other. In addition, male connection end 144A and female connection end 145B of inner tubes 140A and 140B, respectively, are shown connected to each other such that inner tubes 140A and 140B are in communication with each other, fluid under pressure may be conveyed through annular channels 150A and 150B, and cuttings and fluid under pressure may be conveyed through the inner tubes 140A and 140B.

Figure 5B:
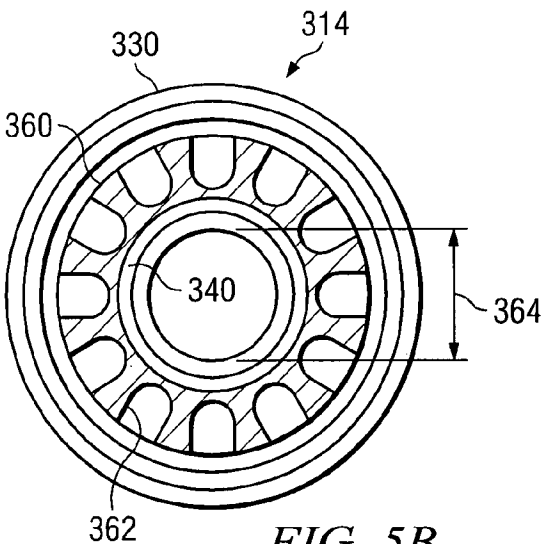
FIG. 5B is a cross-sectional view of an alternative embodiment of the flexible sleeve in accordance with the present invention.
Figure 5A:
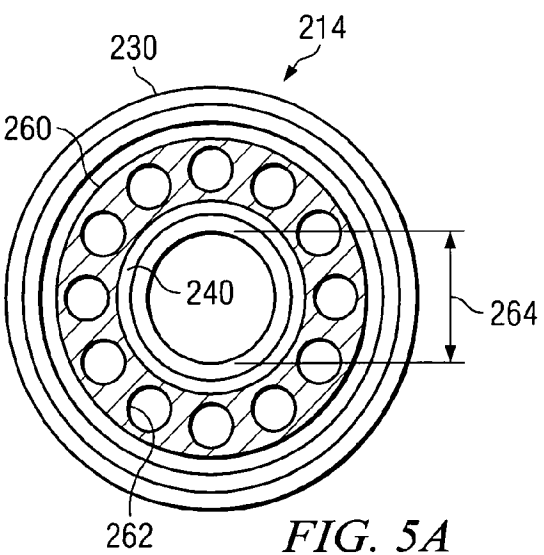
FIG. 5A is a cross-sectional view of a preferred embodiment of the flexible sleeve in accordance with the present invention.

Referring now to FIGS. 5A and 5B, two cross-sectional views of preferred embodiments of dual wall pipe sections 214 and 314, respectively, are illustrated. As shown in FIG. 5A, preferred pipe section 214 includes outer tube 230, inner tube 240 and flexible sleeve 260. Flexible sleeve 260 includes a plurality of holes 262. Holes 262 are adapted to permit fluid under pressure to be conveyed there through. It is contemplated that the cumulative area of holes 262 in flexible sleeve 260 may be greater than the cross-sectional area defined by inner tube inner diameter 264. It is also contemplated that the cumulative area of holes 262 in flexible sleeve 260 may be less than or equal to the cross-sectional area defined by inner tube inner diameter 264.

Referring now to FIG. 5B, preferred dual wall pipe section 314 includes outer tube 330, inner tube 340 and flexible sleeve 360. Flexible sleeve 360 includes a plurality of apertures 362. Apertures 362 are adapted to permit fluid under pressure to be conveyed there through. It is contemplated that the cumulative area of apertures 362 in flexible sleeve 360 may be greater than the cross-sectional area defined by inner tube inner diameter 364. It is also contemplated that the cumulative area of apertures 362 in flexible sleeve 360 may be less than or equal to the cross-sectional area defined by inner tube inner diameter 364. While FIGS. 5A and 5B illustrate flexible sleeve 260 having a plurality of round holes 262 and flexible sleeve 360 having a plurality of arched apertures 362, respectively, it is contemplated within the scope of the invention that one or more openings of any suitable configuration and location may be provided in the flexible sleeves of the present invention.

Figure 6:
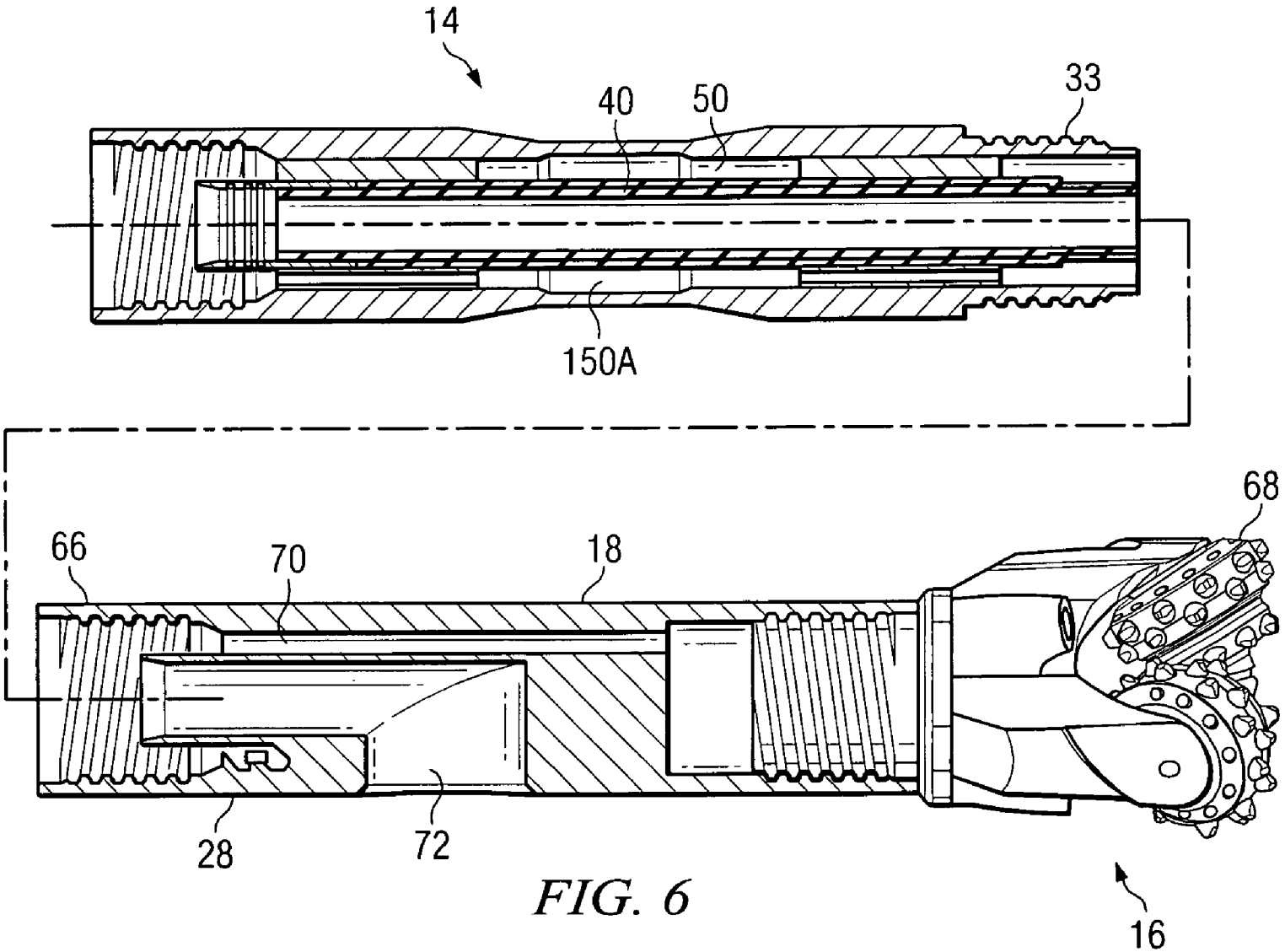
FIG. 6 is a sectional side view of a preferred dual wall drill string pipe section and a drilling mechanism.

Referring now to FIG. 6, preferred dual wall pipe section 14 is illustrated in a nearly-connected relationship to interchange sub 18. Preferred pipe section 14 is illustrated in FIGS. 1 and 2 and described in detail above. As shown in FIG. 6, threaded end 33 is adapted to be connected to threaded end 66 of interchange sub 18. Drilling mechanism 16 includes navigation transmitter 28, cutting head 68, fluid channel 70, and cuttings channel 72. Drilling head 68 is adapted to drill a subsurface borehole as illustrated in FIG. 1. Drilling head 68 may be any suitable mechanism for drilling a subsurface borehole. Fluid channel 70 is adapted to convey fluid under pressure from annular channel 50 of pipe section 14 to drilling head 68 of drilling mechanism 16. Fluid channel 70 maybe of any suitable conventional configuration adapted to convey fluid under pressure toward the drilling head of the drilling mechanism. Cuttings channel 72 is adapted to convey cuttings produced by the drilling head of the drilling mechanism from the subsurface borehole to inner tube 40 of pipe section 14. Cuttings channel 72 on interchange sub 18 may be of any suitable configuration for conveying cuttings from the drilling mechanism to the inner tube of one or more dual wall pipe sections.

Figure 7:
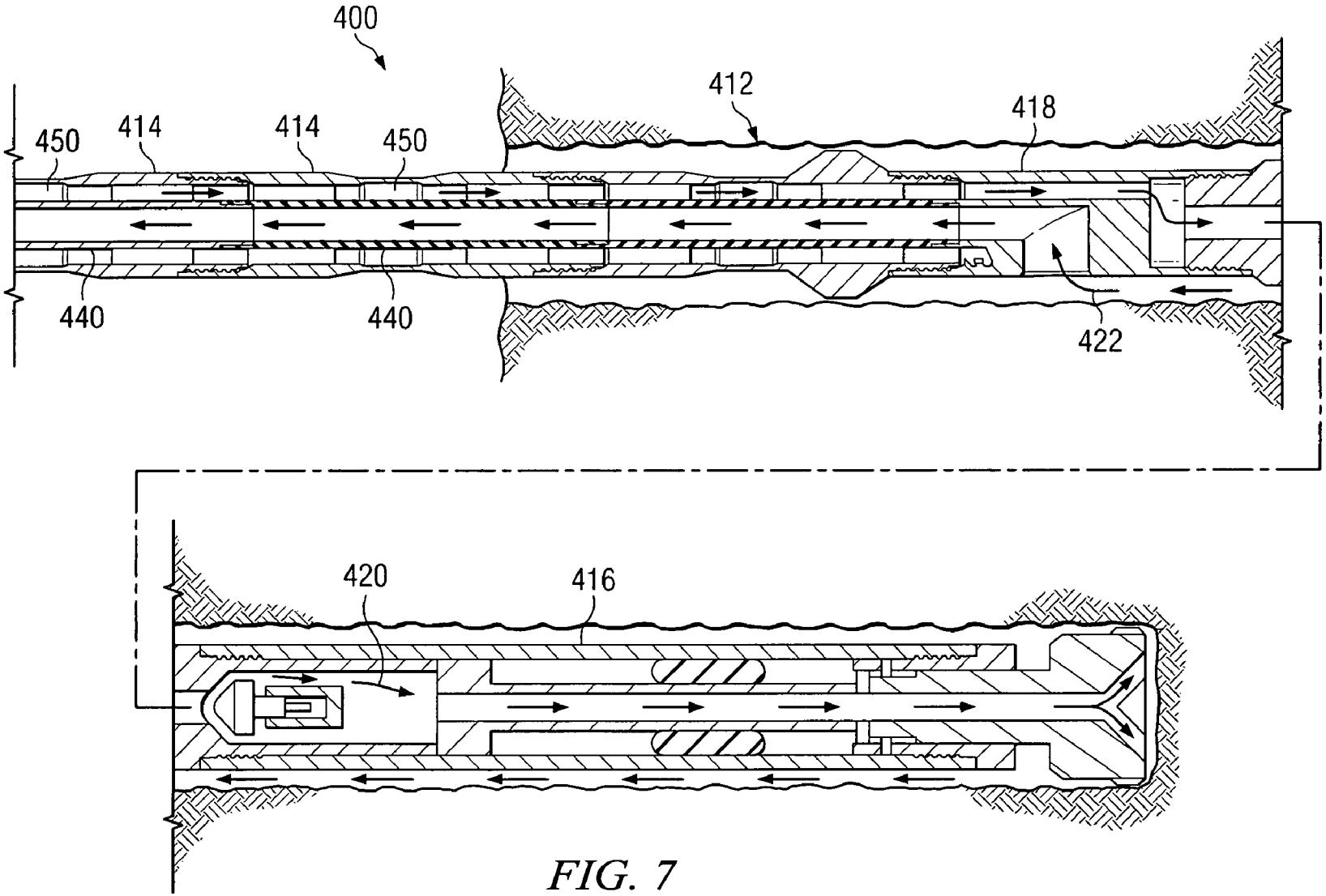
FIG. 7 is a sectional side view of an alternative embodiment of the dual wall drill string assembly partially in a subsurface borehole in accordance with the present invention.

Referring now to FIG. 7, an alternative embodiment of the dual wall drill string assembly is illustrated. More particularly, FIG. 7 illustrates a preferred dual wall drill string assembly utilizing a drilling mechanism commonly known as a down-the-hole percussion hammer. As shown in FIG. 7, preferred assembly 400 includes a plurality of dual wall pipe sections 414 connected to each other. The drill string of dual wall pipe sections 414 is connected to drilling mechanism 416 by interchange sub 418. Drilling mechanism 416 is adapted to drill subsurface borehole 412. Interchange sub 418 is adapted to convey cuttings from drilling mechanism 416 to inner tubes 440 of pipe sections 414. The flow of fluid conveyed under pressure from annular channels 450 of pipe sections 414 through interchange sub 418 and, thereafter, towards drilling mechanism 416 is designated by arrowed line 420. The flow of cuttings and fluid under pressure from drilling mechanism 416 to interchange sub 418 and, thereafter, to the inner tubes of pipe sections 414 is designated by arrowed lines 422.

Figure 8:
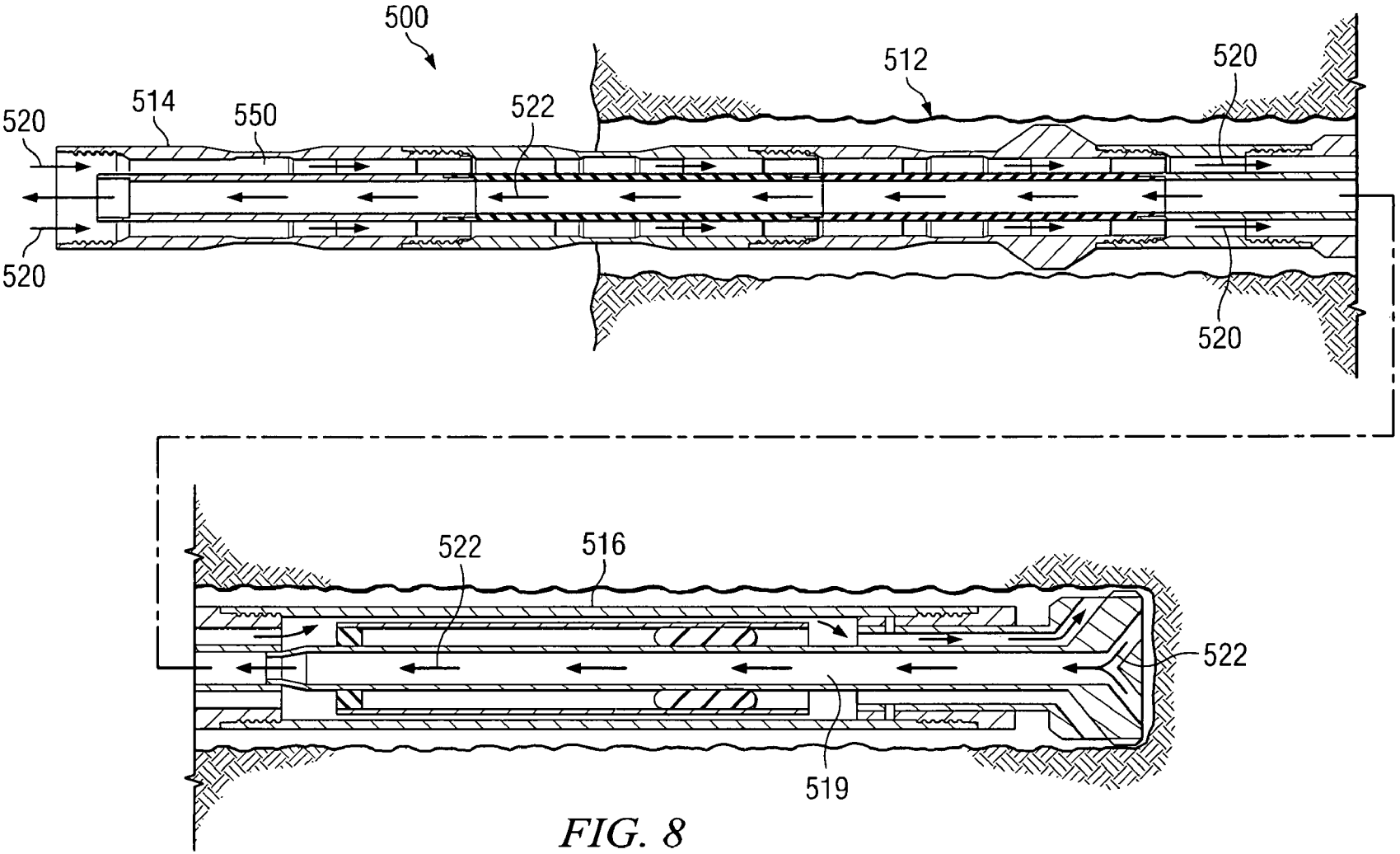
FIG. 8 is a sectional side view of an alternative embodiment of the dual wall drill string assembly partially in a subsurface borehole in accordance with the present invention.

Referring now to FIG. 8, an alternative embodiment of the dual wall drill string assembly is illustrated. More particularly, FIG. 8 illustrates a preferred dual wall drill string assembly without an interchange sub. As shown in FIG. 8, preferred assembly 500 includes dual wall pipe section 514 which is connected directly to drilling mechanism 516. Drilling mechanism 516 is adapted to drill subsurface borehole 512. Drilling mechanism 516 includes cuttings channel 519 which is adapted to convey cuttings from the drilling mechanism to the dual wall pipe section. The flow of fluid conveyed under pressure through annular channel 550 of pipe section 514 towards drilling mechanism 516 is designated by arrowed lines 520. The flow of cuttings and fluid under pressure from drilling mechanism 516 to the inner tube of pipe section 514 is designated by arrowed line 522. The foregoing describes the operation of a reverse circulation down-the-hole hammer.

Figure 9:
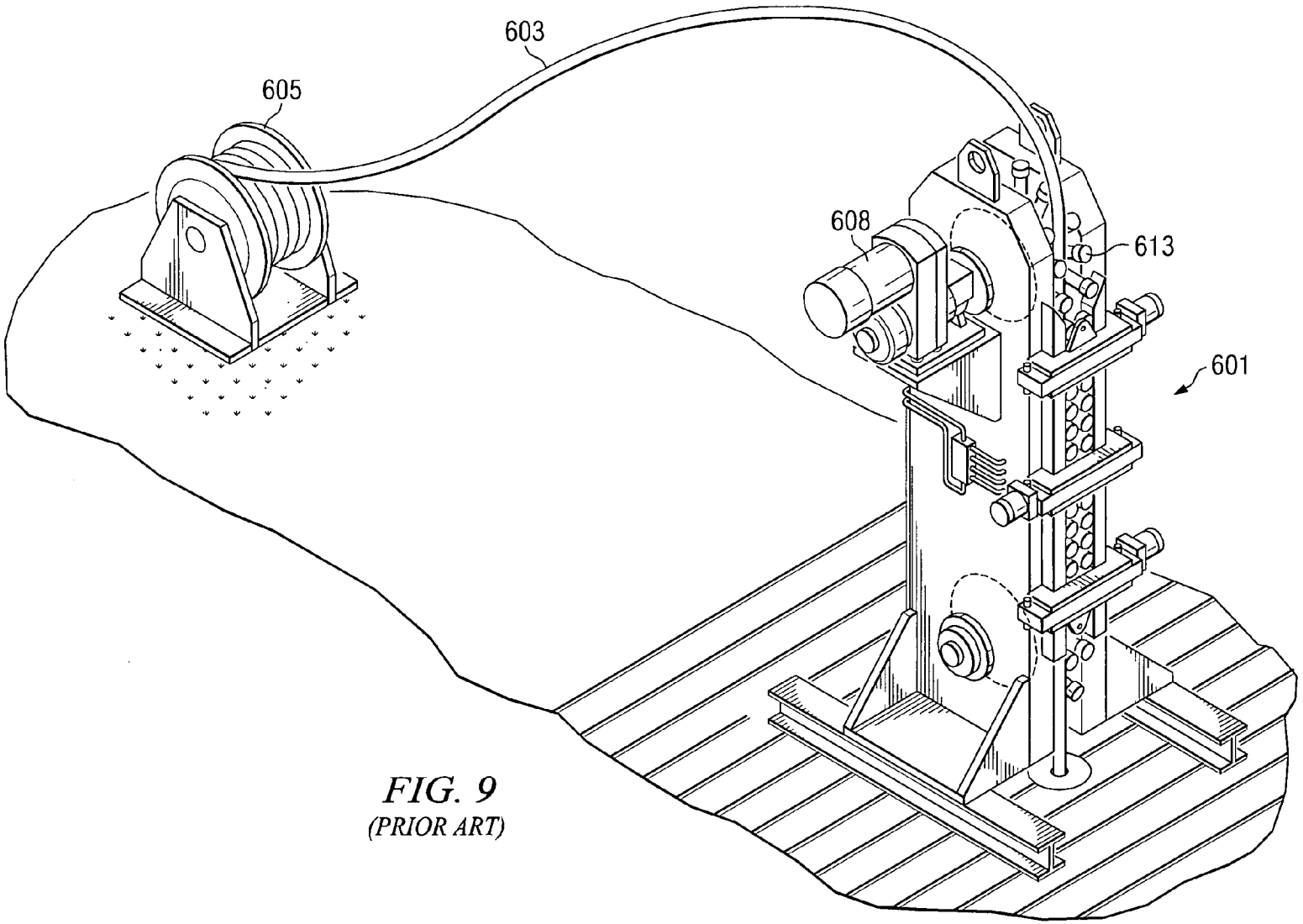
FIG. 9 (PRIOR ART)
FIG. 9 is a perspective view of a typical prior art coil tubing injector unit showing the tubing being fed from a spool to the well bore.

The dual wall drill string assembly of the invention may also take the form of a coil tubing drill string, as will now be described. Turning now to FIG. 9, there is shown a prior art coil tubing injector unit designated generally as 601. While units of this general type have been known in the art for many years, the unit 601 is illustrated in order to explain the environment of the improved coil tubing system of the invention. Unlike the jointed dual wall pipe discussed up to this point, the coil tubing injector system of FIGS. 9 and 10 utilizes a continuous length of tubing 603 which is dispensed from a spool or reel 605 located at the well surface. Traditional coil tubing is manufactured in continuous lengths by fabricating highly ductile steel. The first steels utilized were high strength, low alloy materials, and with only minor modifications this type steel remains the standard for coil tubing today. Early coil tubing utilized 40,000 psi (40-ksi) and 50,000 psi (50-ksi) yield strength steel which was provided in 0.049 -in, thick sheets. Tubing was milled in 250 to 2,000 foot long sections, and strings were assembled by butt-welding the tube sections together using TIG and MIG techniques. The continuous tubing was wound onto tubing service reels with 48 inch core diameters being typical.

Figure 10:
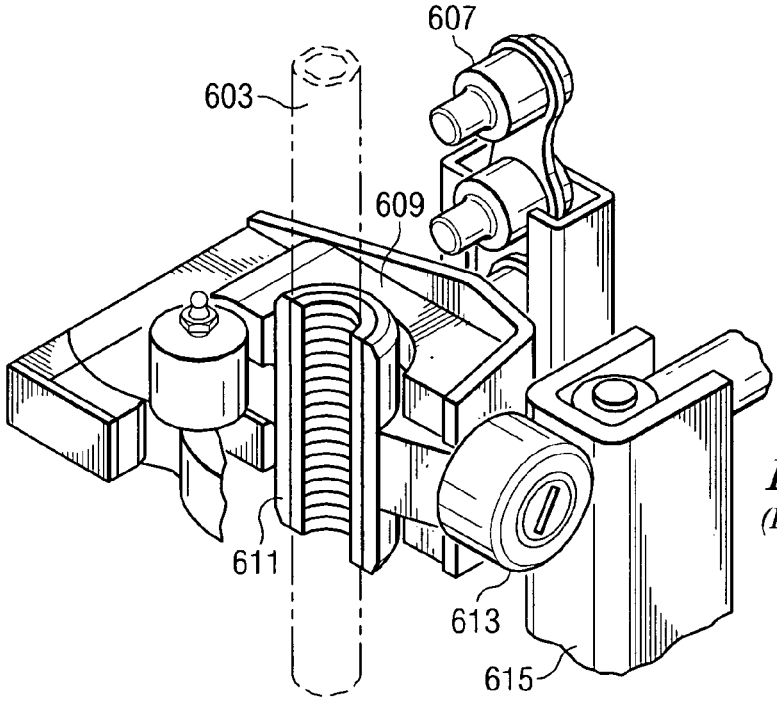
FIG. 10 (PRIOR ART)
FIG. 10 is a close-up view of a gripper block assembly which is used to grip and feed the coil tubing into the well bore.

As generally shown in FIGS. 9 and 10, the coil tubing 603 is fed between a contra-rotating, hydraulically powered chain drive system (607 in FIG. 10) which carries a plurality of gripper block assemblies 609. The drive motor is illustrated at 608 in FIG. 9. The gripper block assemblies include C-shaped clamp regions 611 and rollers 613. The rollers 613 ride on the tracks of a vertical run 615. The gripper block assemblies are pivoted between disengaged and engaged positions with respect to the coil tubing being fed within the vertical run of the injector unit. The gripper block assemblies and chain drive provide the gripping force necessary to feed the continuous length of tubing into the well bore. The operation of commercially available coil tubing injector units will be well understood by those skilled in the relevant arts.

Figure 11:
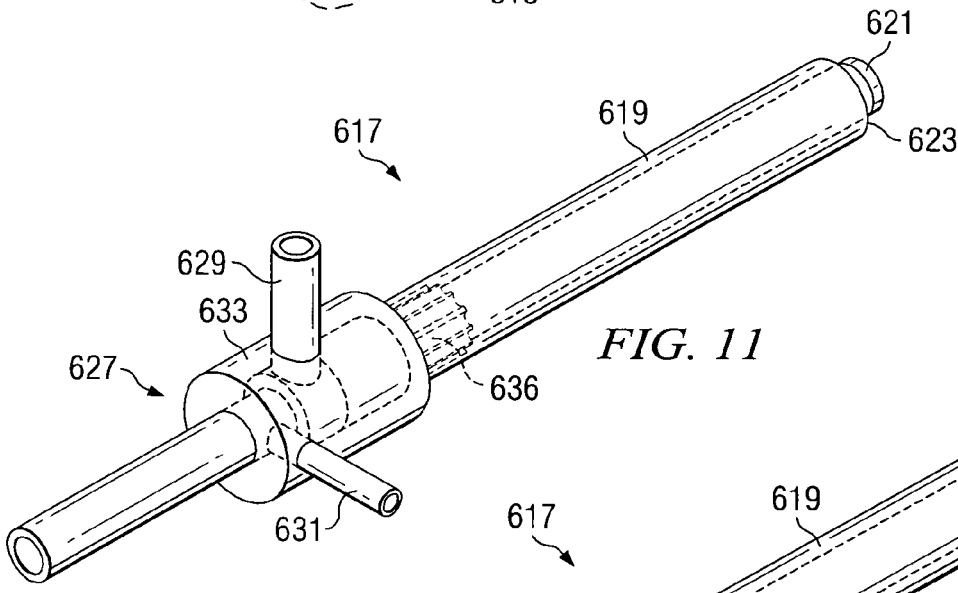
FIG. 11 is a simplified, schematic view of the surface end of a length of the improved coil tubing of the invention.
Figure 12:
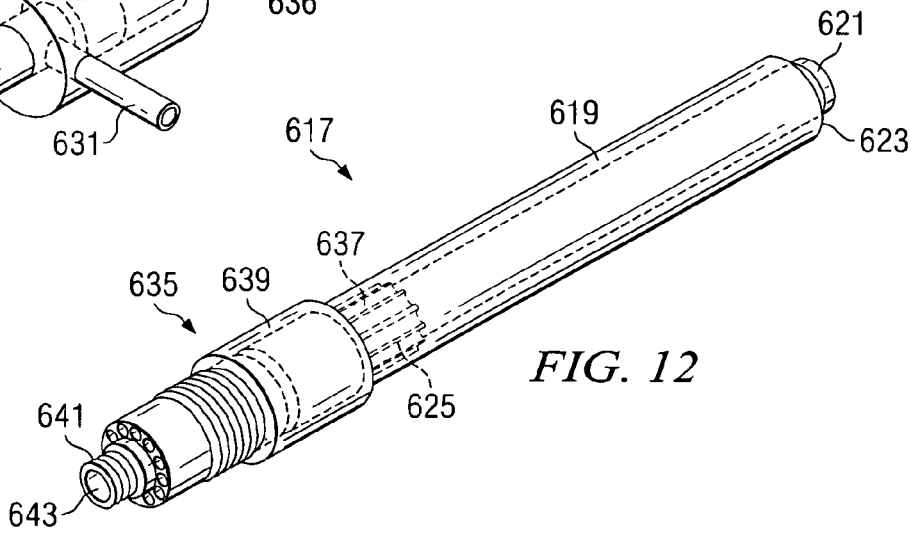
FIG. 12 is a simplified, schematic view of the bit or down hole end of the length of coil tubing of FIG. 11.
Figure 13:
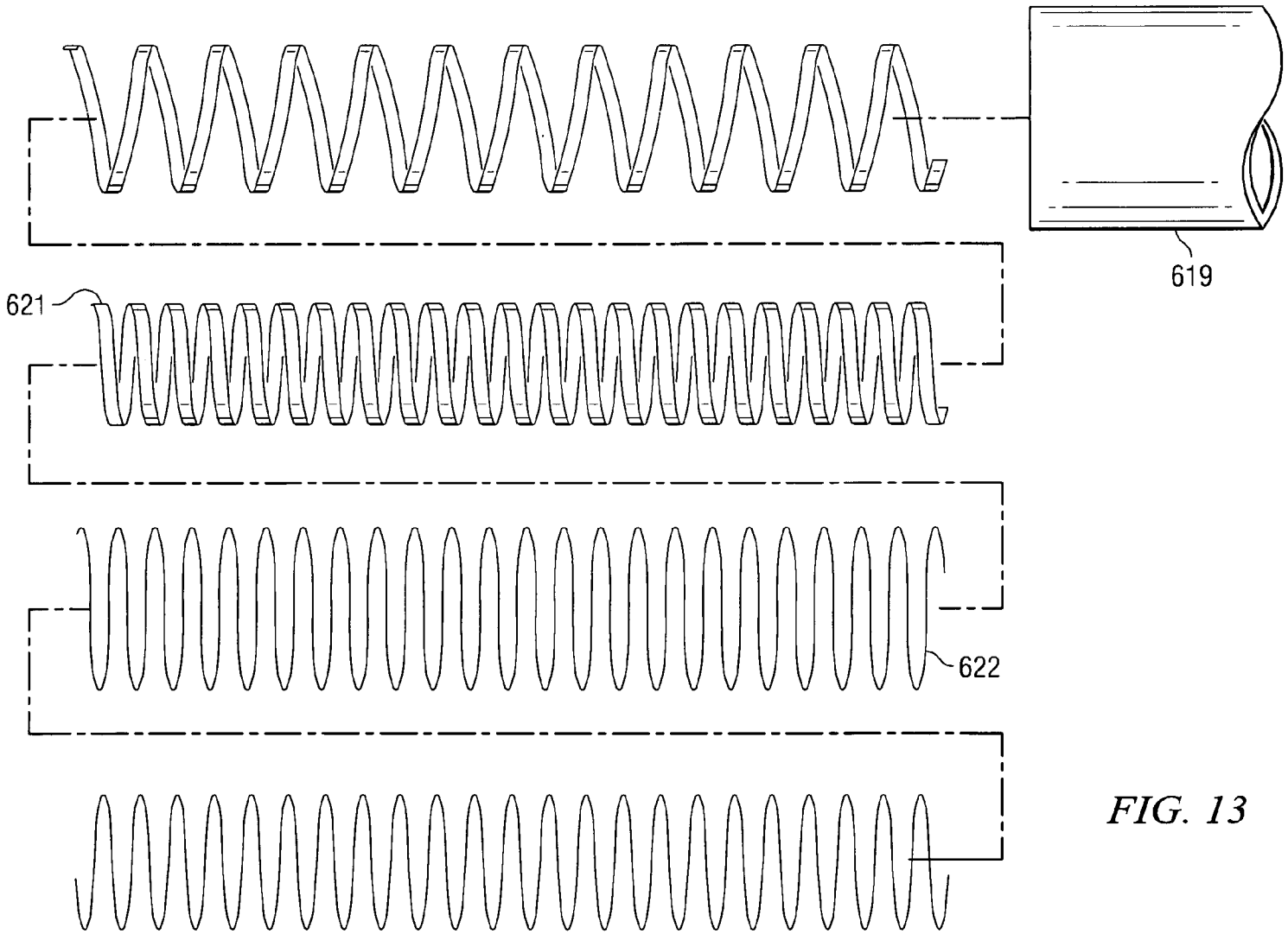
FIG. 13 is a simplified, exploded view of a portion of the coil tubing of FIGS. 11 and 12, showing the inner tube and wire assembly.

FIGS. 11–13 show one embodiment of the improved coil tubing of the invention. Turning first to FIG. 11, there is shown the exit or surface end 617 of the coil tubing. As described with respect to the jointed, dual wall drill pipe, the coil tubing of the invention has an outer, metallic pipe 619 and an inner non-metallic tube or layer (621 in FIG. 13). In the embodiment of the invention illustrated in FIGS. 11–13, the inner, non-metallic tube 621 is provided with wire reinforcement (shown in exploded fashion as 622 in FIG. 13). An annular region (generally at 623 in FIGS. 11 and 12) separates the outer pipe 619 and inner tube 621. Fluid and cuttings flow through the interior of the inner tube toward an exit at the well surface. The annular space between the inner tube and outer pipe allows the fluid flow to be supplied to the cutter or bit.

In the embodiment of FIG. 11, a webbed centralizer 636 assists in separating the inner tube and outer pipe and lets air or other fluid pass freely. While only one centralizer 636 is shown in the embodiment of FIG. 11, it will be understood by those skilled in the art that one or more centralizers 636 may be needed to keep the inner tube and outer pipe separated, or the centralizer could be an integral part of the inner tube throughout the length thereof. In this case, a plurality of centralizers could be located throughout the length of the inner tube. The surface end of the coil tubing is also supplied with a fluid supply and communication and/or power transmission adapter 627 which includes an inlet 629 for fluid supply flow inwardly from the reel swivel. The adapter 627 also includes a conduit opening 631 which accepts cabling leading to a control console. The length of coil tubing is attached to the adapter 627 by means of a standard coil tubing connection (generally at 633) of the customer's preference.

FIG. 12 shows the bit end 635 of the coil tubing of the invention. The inner tube 621 can be used to encase communication and power transmission cables. A second centralizer 637 is used to ensure the free passage of air or other fluid. In the embodiment of FIG. 12, the coil tubing is attached to a tubing end adapter 639. The end adapter 639 has communication and power transmission connectors 641 molded onto the end of the inner tube 643. Note that the inner and outer tubes are separated only by the centralizers 636 and 637 in the embodiment of the invention illustrated in FIGS. 11 and 12. The centralizers are located generally adjacent the air and wire adapter 627 at one end of the length of tubing and adjacent the bit end at the other extent of the tubing.

The bit end 635 of the coil tubing apparatus shown in FIG. 12 would typically be connected to a conventional downhole electric, hydraulic and/or air motor (not shown). Most downhole motors used in coil tubing drilling operations are smaller versions of their jointed pipe versions. Downhole motors consist of a rotor and stator combination and use fluid flow to generate torque dowhhole. Electric motors are more recent introductions into the industry but, if incorporated, allow the motor assembly to be shortened in order to undertake a tighter turning radius. Additionally, an electronically controlled bent sub can be incorporated into the assembly of the invention so that the bend angle can be controlled or eliminated when the string is required to follow a straight path. The electronically controlled bent sub can also enable the use of special drilling techniques so that casing can be run simultaneously during the drilling operation and pulled through the casing, leaving the casing in place. The size, number of lobes and efficiency of the motor, determine the fluid-flow requirements, the output torque and speed. The typical sizes used in coil tubing drilling operations range from 1 11/16" to 3 1/4" OD. Most motors also incorporate a method for adjusting the bend at the bottom of the motor. This mechanical adjustable kick-off angle allows for different dogleg severity's depending on the application and well design. For some applications, drilling with very high quality foams and mist, turbine motors have also been used to some degree. As will be understood by those skilled in the coil tubing arts, the typical coil tubing string will include such other components as connectors, shear subs, float valves, orienting devices, measurement while drilling devices, dump or equalizer subs, in addition to the downhole motor.

Figure 14:
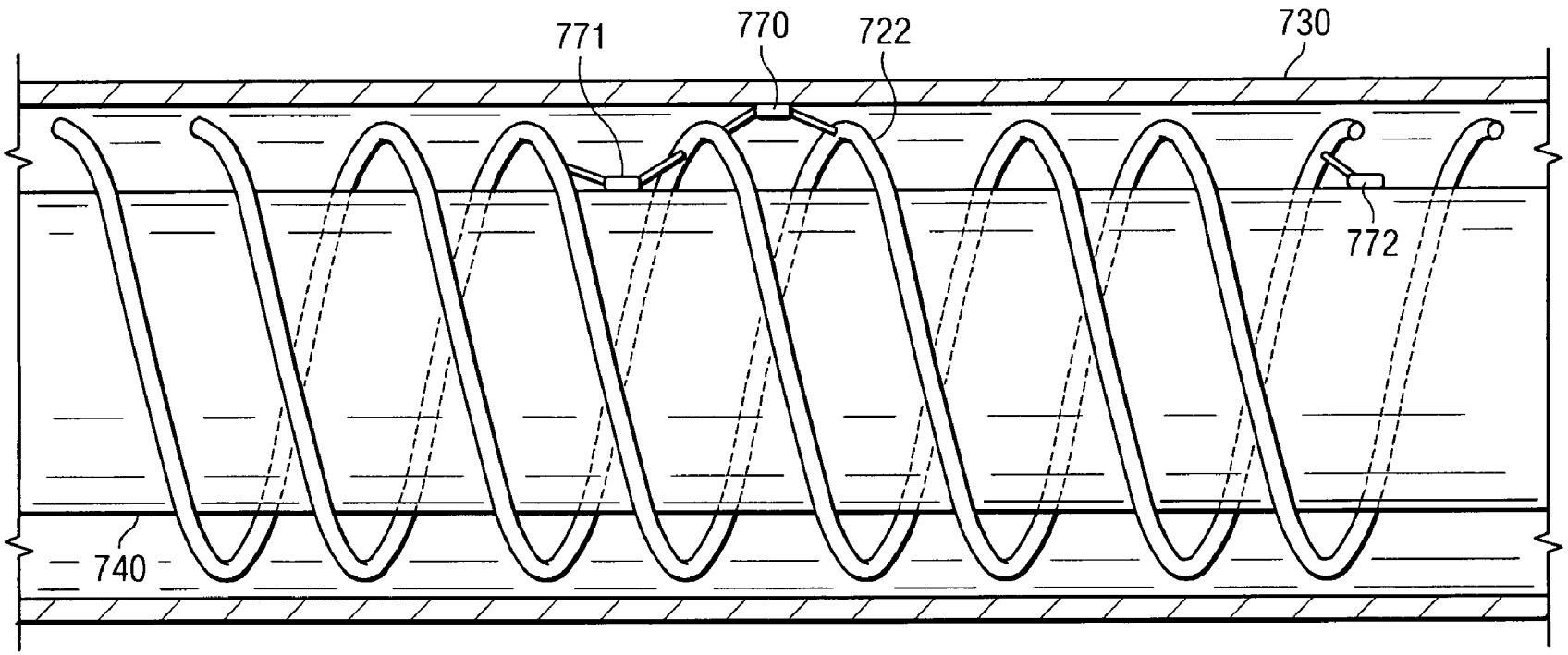
FIG. 14 is a sectional view of sensors located within the wall of an inner tube.

FIG. 14 is an illustration of an annulus sensor 770 that measures pressure between the inner tube 740 and outer tube 730. The annular sensor 771 measures pressure inside the inner tube 740. Both sensors are connected to one or more communication cable(s) 722 to enable communication to the drilling operators console, and/or computer, and/or blowout preventer(s). In similar fashion, sensor 772 is a gas detector connected to communicate with the conductive element (in this case communication cable 722) for communicating information related to the presence or absence of gases along the drill string assembly from a subsurface location to a location at the well surface. These sensors perform important and sometimes critical functions in "smelling" important gases and compliment the action of the pressure sensors 770 and 771 in monitoring abnormal pressures that may cause a blowout. This type of detection down hole rather than at the well surface offers distinct advantages, since problems such as high pressure kicks can be detected earlier before becoming a major problem at the surface. Also, because the sensors are electrical sensors, an associated computer or programmable logic controller (PLC) can immediately perform safety measures such as closing in blowout preventers, dumping of heavy mud down hole, signaling alarms and other related tasks. The pressure sensors also can compare the pressure differential to help monitor the integrity of the operation. The higher the differential, the less efficient the drilling operation. The "Smelling" sensors which are installed can detect certain problem gases such as $H_2S$. It is better to detect this gas at its source before it is detected at the well surface.

Figure 15:
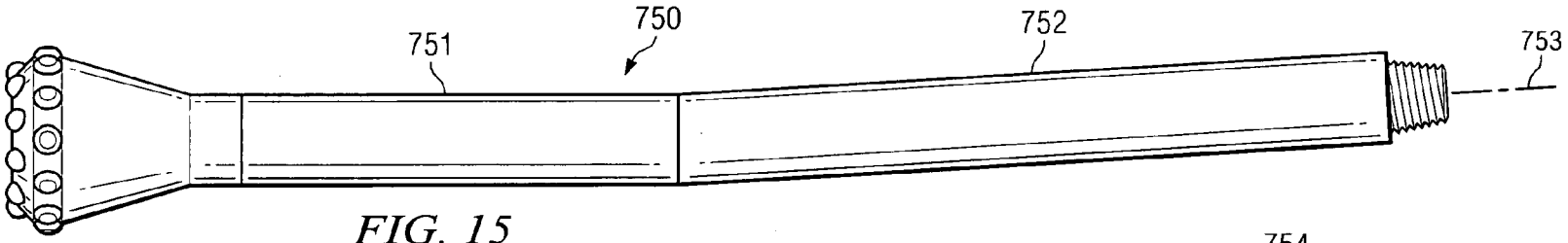
FIG. 15 is an assembly view of a typical mud motor.

FIG. 15 is an illustration of a typical mud motor 750. The mud motor illustrated in FIG. 15 includes a bent section 751 as a part of the assembly. This bent section 751 can rotate separately from the remaining straight section 752. This enables the drill pipe assembly to drill at an angle relative to the horizontal axis 753 of the straight section 752. If the drill pipe is pushed further into the hole without the drill pipe assembly rotating, the bent section 751 of the mud motor will continue to drill at an increasing angle. This action creates a radius or segmented radius depending upon the drilling technique being utilized. If the straight portion 752 of the mud motor is rotated, theoretically the mud motor assembly will drill straight ahead, thus drilling a straight hole. Mud motors are generally driven by fluids at high volume rates forced through the center of the conventional drill pipe. At the intersection between the bent portion and the straight portion is a conventional adjustable angular mechanical adjuster (not shown) that is used to control the angle of deviation of the drill string. Normally the adjustment must be made by loosening bolts and clamps inside the structure. This generally requires that the adjustment be performed above ground, normally inside a machine shop or controlled shelter.

Figure 16:
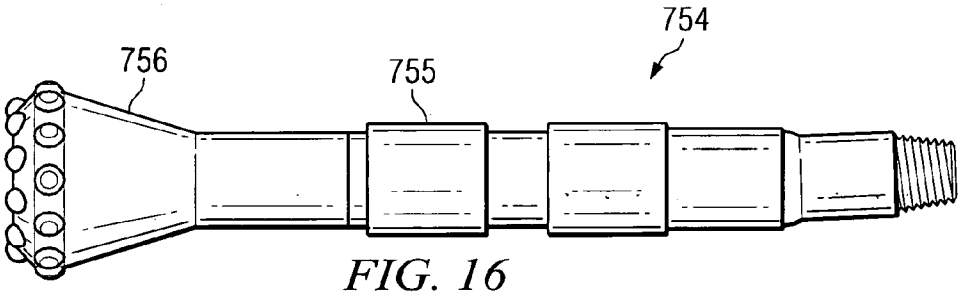
FIG. 16 is an assembly view of an electrical motor, similar in function to FIG. 15.

FIG. 16 is an illustration of an electric drill motor assembly 754 similar in function to the mud motor 750 of FIG. 15. However, in this case, the assembly 754 incorporates an electric motor 755 which drives the bit 756 rather than being driven by drilling fluids. The illustration in FIG. 16 shows a simple arrangement for an electrical drill motor assembly. In practice, there may be several motors in series to achieve increased drilling torque. A major advantage in an electric design is that the length of the assembly can be shortened considerably. Also, in the electrical drill motor assembly illustrated in FIG. 16, the mechanical adjuster would be the same as discussed with respect to FIG. 15.

Figure 17:
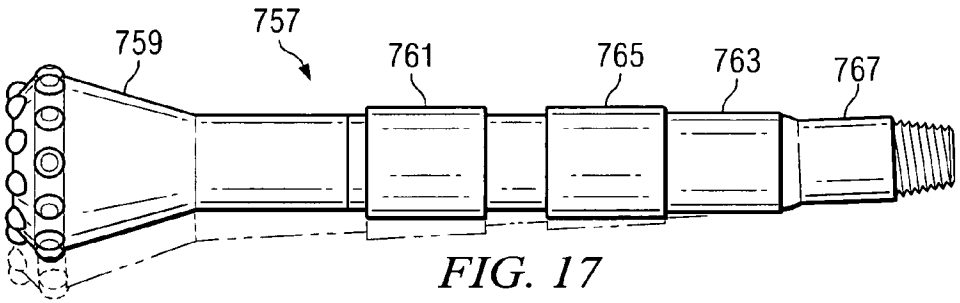
FIG. 17 is an assembly view of the electrical drill motor assembly of FIG. 16 combined with an electrical angle adjustment bent sub.

FIG. 17 is an illustration similar to FIG. 16 of an electrical drill motor assembly 757 including a drill bit 759, an electric motor 761, a bent sub 763 and a second motor 765 on the bent sub. The pivot sub 767 can clamp and unclamp electrically so that the pivot angle can be controlled while drilling. In this case, it incorporates an angular adjuster which would be electrical/mechanical in nature instead of being totally mechanical in nature as previously described. This type of design enables the angle adjustment to be made down hole. Also, the drill assembly can be adjusted to a straight position. As a result, the drill string will not need to rotate in order to drill a straight hole.

Figure 18:
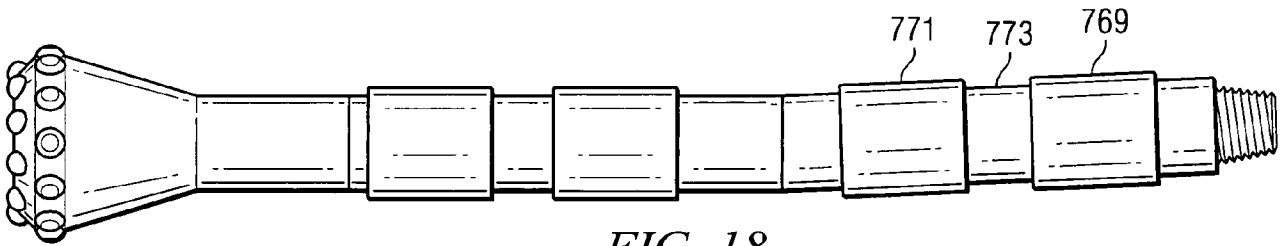
FIG. 18 is an assembly view of the electrical drill motor assembly of FIG. 16 combined with a mechanical angle adjustment bent sub.

FIG. 18 is an illustration similar to FIG. 16, except that one or more electrical motors 769, 771 are mounted on the straight section 773. These additional motor(s) provide the ability to drill without rotating the drill string, which in turn increases the fatigue life of the drill string. However, the mechanical adjuster would be fixed and non adjustable down hole. Another advantage of eliminating the need to rotate the drill string is the ability to run the assembly utilizing coil tubing. Coil tubing is not normally rotated during drilling operations.

The electrical motors which are illustrated in FIGS. 16–18 can have hollow shafts and be lined with the same material as the drill string inner tubes. Also the casing of the electrical motors can have cooling vents plumbed in order to channel the fluids to the hammer bit or conventional bits for cutting.

In operation, several advantages of the dual wall drill string assembly of the present invention are achieved, whether with jointed, dual wall pipe or with coil tubing. First, a borehole is drilled by the drilling mechanism. The cuttings produced by the drilling mechanism are conveyed to the inside of the flexible, substantially non-metallic inner tube of the dual wall drill string as fluid under pressure is conveyed through the annular channel of the drill string toward the drilling mechanism. Moreover, the dual wall and coil tubing drill string assemblies of the invention claimed herein are adapted for use in all subsurface drilling applications. The flexible, substantially non-metallic (and if practical, non-conductive material) inner tube of the drill string assembly of the present invention permits the assembly to be used in all subsurface drilling applications because the inner tube is flexible and transmits considerably less bending resistance to the outer tube. In addition, the flexible, substantially non-metallic, and possibly non-conductive inner tube is adapted to substantially enclose a conductive element for conveying a signal to the navigation transmitter. Consequently, the direction of the drilling mechanism can be monitored, and short circuiting of the conductive element on the metallic outer tube is avoided. Flexible sleeves also contribute to the ability of the preferred embodiment of the dual wall and coil tubing drill assemblies of the present invention to function in any subsurface drilling applications. Further, according to the method of the invention claimed herein, the dual wall and coil tubing drill string assemblies are capable of reaming the arcuate path of a borehole in any subsurface drilling applications. Still further, the assembly is capable of pulling or pushing a product such as pipeline, ducts and the like into the arcuate path of a subsurface borehole. The inner tube wall also can have pressure sensors along the length of the string to monitor the pressures and detect any abnormal pressures that maybe unanticipated from down hole formations. Additionally, the inner tube wall can have sensors to detect the presence of hazardous gas.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A dual wall coil tubing drill string assembly for subsurface drilling which allows dual circulation, said assembly comprising (A) a metallic outer tube formed as a continuously-milled tubular product manufactured in lengths which require spooling onto a take-up reel during the primary milling or manufacturing process, the outer tube having:

(1) an outer tube first end;

(2) an outer tube second end opposite the outer tube first end;

(B) a flexible, substantially non-metallic inner tube that is formed of an elastomeric material which differs from the material of the metallic outer tube and that is substantially enclosed within and generally coaxially aligned with the outer tube, said inner tube having:

(1) an inner tube first end, (2) an inner tube second end opposite the inner tube first end which defines a tube length therebetween, (3) an inner tube inner diameter which is generally constant along the tube length from the inner tube first end to the inner tube second end, wherein the inner tube and the outer tube define an annular channel therebetween, (C) a means for conveying fluid through the annular channel toward the inner tube first end, wherein the annular channel is adapted to convey drilling fluid under pressure toward the inner tube first end, and the inner tube is adapted to convey cuttings toward the inner tube second end; and wherein the inner tube includes at least one conductive element for conveying a signal and/or electricity, the conductive element being substantially embedded and enclosed within the flexible, non-metallic elastomer material of the inner tube.

2. The assembly of claim 1, wherein the outer tube has a surface end and a bit end and wherein one or more centralizers are located in the annular channel formed between the inner and outer tubes adjacent each of the surface end and bit end of the coil tubing, respectively, to assist in maintaining the annular channel between the outer tube and inner tube.

3. The assembly of claim 1, wherein the outer tube of the drill string assembly has a surface end and a bit end and wherein the surface end of the coil tubing is also supplied with a fluid supply and wire adapter which includes an inlet for fluid supply flow inwardly and which also includes a conduit opening which accepts communication and power transmission conductors leading to a surface control console.

4. The assembly of claim 1, wherein the outer tube of the drill string assembly has a surface end and a bit end and wherein the bit end of the coil tubing includes a tubing end adapter which has communication and power transmission connectors.

5. The assembly of claim 1, wherein the outer tube of the drill string assembly has a surface end and a bit end and further comprises centralizers located between the outer and inner tubes, and wherein the inner and outer tubes are separated only by the centralizers which are located adjacent the bit end and surface end of the coil tubing, respectively.

6. The assembly of claim 1, wherein the outer tube of the drill string assembly has a surface end and a bit end and wherein the bit end of the coil tubing apparatus is connected to a downhole motor.

7. The assembly of claim 1, wherein one or more pressure sensors are connected to communicate with the conductive element for communicating pressure information along the drill string assembly from a subsurface location to a location at the well surface.

8. The assembly of claim 1, wherein one or more gas detectors are connected to communicate with the conductive element for communicating information related to the presence or absence of gases along the drill string assembly from a subsurface location to a location at the well surface.

9. The assembly of claim 1, wherein the conductive element is continuous from the inner tube first end to the inner tube second end.

10. The assembly of claim 1, including a steering mechanism adapted to receive the signal from the conductive element and monitor the direction of the drilling mechanism.

11. The assembly of claim 1, wherein the conductive element is substantially enclosed within the inner tube.

12. The assembly of claim 1, wherein the conductive element comprises at least one metallic or fiber optic material.

13. The assembly of claim 1, wherein the conductive element comprises metallic wire, metallic mesh or thin wall pipe.

* * * * *